US007556235B1

(12) United States Patent
Farris

(10) Patent No.: US 7,556,235 B1
(45) Date of Patent: Jul. 7, 2009

(54) EARTHQUAKE PROOF PICTURE HANGING SYSTEM

(76) Inventor: Louis S. Farris, P.O. Box 211926, Anchorage, AK (US) 99521

( * ) Notice: Subject to any disclaimer, the term of this patent is extended or adjusted under 35 U.S.C. 154(b) by 246 days.

(21) Appl. No.: 11/523,910

(22) Filed: Sep. 19, 2006

(51) Int. Cl.
*B60R 1/02* (2006.01)

(52) U.S. Cl. ..... 248/468

(58) Field of Classification Search ..... 248/475.1–480, 248/489
See application file for complete search history.

(56) References Cited

U.S. PATENT DOCUMENTS 2,904,290 A * 9/1959 Mullen et al. ..... 248/480
3,020,013 A * 2/1962 Zeil et al. ..... 248/493
3,343,773 A * 9/1967 Lorenz ..... 248/217.2
5,029,498 A * 7/1991 Kinsey ..... 81/451
2002/0092959 A1* 7/2002 Szarata ..... 248/489
2006/0065080 A1* 3/2006 Davidson et al. ..... 81/63

* cited by examiner

*Primary Examiner*—J. Allen Shriver, II
*Assistant Examiner*—Erin Smith
(74) *Attorney, Agent, or Firm*—Michael J. Tavella

(57) ABSTRACT

The instant invention uses spring-loaded clips that mount to the back of a frame. The picture is then hung on a wall by slipping these clips over hooks or nails secured to a wall. The hooks are secured in the spring-loaded clips and cannot be removed without a special tool. The clips are made in several sizes to support small, medium, large and very large frames. The clips are made from punched metal that is folded into the clip form. A small spring is secured to the clip to ensure smooth action of the clips in use and to provide a tight, secure fit when the picture is hung.

20 Claims, 11 Drawing Sheets

EARTHQUAKE PROOF PICTURE HANGING SYSTEM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to picture hanging systems and particularly to picture hanging systems that are earthquake proof.

2. Description of the Prior Art

Picture hanging is a technique that goes back centuries. Today, there are a few different systems for hanging pictures, photographs and other framed art works. The simplest is to hang the frame on a nail driven into a wall. While easy and fast, it is not a very secure way to hang a picture. Another common way to hang a picture is to attach a length of wire to the back of the frame and to hang the wire on a nail or hook. While much more secure, it is subject to failure if the nail or hook is not properly fastened to a wall.

A special consideration involves hanging pictures in earthquake prone areas. A mild earthquake is capable of knocking a poorly hung piece of art off a wall. Even a well-hung piece of art, hung using conventional means, can be damaged by a strong earthquake.

There are many examples of systems for hanging pictures. None of these systems has been specifically designed for earthquake protection, but some could be used for that purpose. Examples of such devices are found in U.S. Pat. No. 3,955,790 to Ballin teaches a clip system that has two parts. One is mounted to a wall and the other is mounted to a picture frame. The device has overlapping arms that are clipped together to hang the painting. U.S. Pat. No. 4,572,470 to Siffert teaches a locking system for picture frames. This device was designed for public areas in which the pictures were subject to theft. The device uses pivoting clips that are spring loaded. One the lips are positioned in the locking position they are locked in place and cannot be removed. The device can be unlocked by using a thin tool. Although this device is useful, it requires modification to the wall to accommodate the springs. Another device is shown in U.S. Pat. No. 6,651,948. This is another spring-loaded system that is designed to project above the top of the picture frame. Although useful, the elements that are visible above the frame distract from the picture.

Published application No. 2003/0039222 A1 to Holmes teaches an overlapping cleat system designed for hanging large objects. This is a variation of the common French cleat used in hanging cabinets in which a piece of wood that has the top beveled is secured to a wall and a second cleat, having the bottom beveled at the same angle is secured to the object. The object is then lifted and slid down until the two cleats mesh. Finally, U.S. Published Application No. 2004/0051022 A1 to Weck et al. teaches a large formed plate that has a number of nail holes formed at the top. A large hook is formed to receive a picture wire. The device is secured to a wall and the picture is hung by slipping the wire over the hook.

While useful, these devices all require complex clips, and fittings that must be attached to a wall to secure the picture. None are specifically designed to secure a picture in an earthquake.

BRIEF DESCRIPTION OF THE INVENTION

The instant invention uses spring-loaded clips that mount to the back of a frame. The picture is then hung on a wall by slipping these clips over hooks, screws, or nails secured to a wall. The hooks are secured in the spring-loaded clips and cannot be removed without a special tool. The clips are made in several sizes to support small, medium, large and very large frames.

The clips are made from punched metal that is folded into the clip form. A small spring is secured to the clip to ensure smooth action of the clips in use and to provide a tight, secure fit when the picture is hung.

DETAILED DESCRIPTION OF THE INVENTION

Note that the structure of the different sized clips is very similar, the main difference being that of size. The manufacturing techniques and materials are the same for all sizes of the first embodiment.

Figure 1:
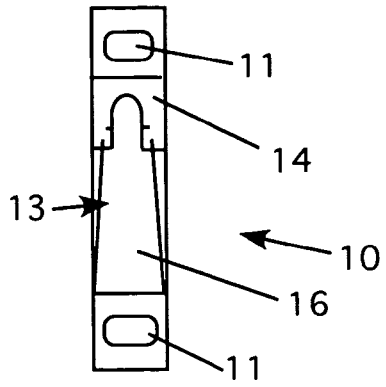
FIG. 1 is a front view of the invention used for small frames.
Figure 2:
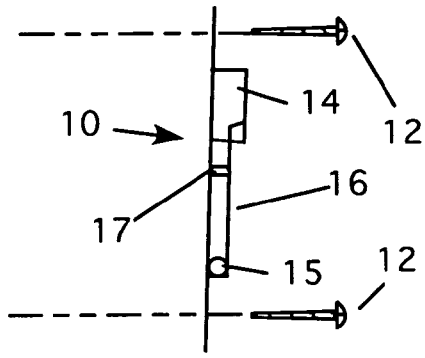
FIG. 2 is a side view of the invention used for small frames.
Figure 3:
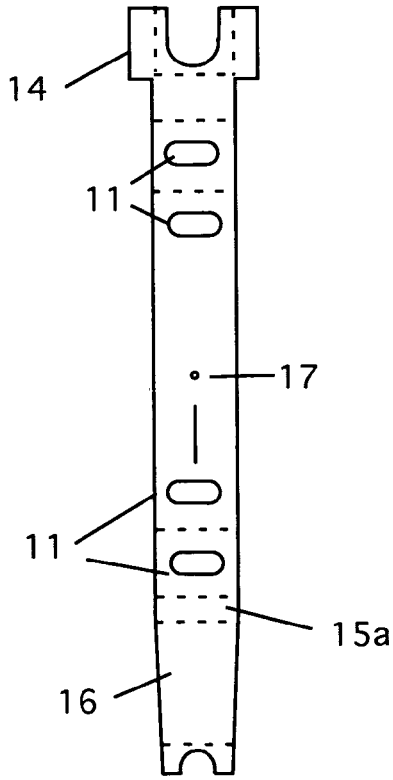
FIG. 3 is a front view of the invention used for small frames as stamped from a piece of metal before forming.

Referring now to FIG. 1, a front view of the invention used for small frames is shown. This figure shows the clip that is mounted to the back of a frame (see FIG. 10). The clip 10 has two holes 11 for fasteners, such as screws or nails 12 that secure the clip to the frame. The clip also has a spring body 13, which is best shown in FIG. 2. FIG. 2 is a side view of the invention used for small frames. In this view, the spring body 13 is shown, as well as the fasteners 12. The spring body has the following features. At the top of the clip is a retainer box 14. At the bottom of the clip is a coil spring 15, which has a front plate 16 attached. The front plate extends up to fit inside the retainer box 14 as shown. In this way, the coil spring provides a force that pushes the front plate forward against the front of the retainer box. A second spring 17 can be added to add further force to keep the front plate securely against the retainer box. The clips can be easily punched out of thin metal and formed into the desired clip shape. FIG. 3 shows a typical piece stamped out for forming. Here, the retainer box 14 is formed by folding the top pieces to form the box. Note that the mounting holes are doubled as shown. The front plate 16 is shown at the bottom of the form. The space 15*a* is used to hold spring 15 when it is folded. The point 17 is for the small auxiliary spring.

Figure 4:
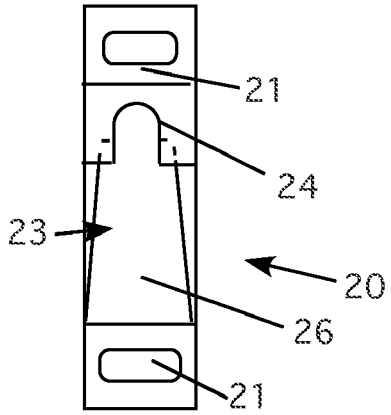
FIG. 4 is a front view of the invention used for medium frames.
Figure 5:
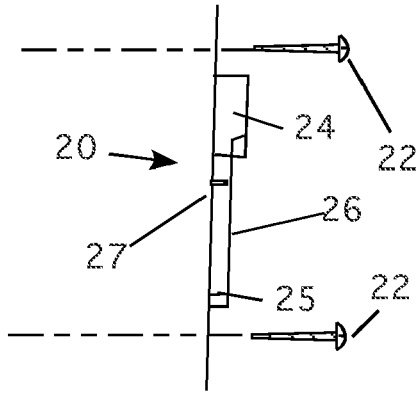
FIG. 5 is a side view of the invention used for medium frames.

FIG. 4 is a front view of the invention 20 used for medium frames. This clip is formed and used in the same manner as that of the small frame clip, described above. The only real difference is the size of the clip. FIG. 5 is a side view of the invention used for medium frames. As before, the clip 20 has two holes 21 for fasteners, such as screws or nails 22 that secure the clip to the frame. The clip also has a spring body 23, which is best shown in FIG. 5. The spring body 23 is shown, as well as the fasteners 22. The spring body has the following features. At the top of the clip is a retainer box 24. At the bottom of the clip is a coil spring 25, which has a front plate 26 attached. The front plate extends up to fit inside the retainer box 24 as shown. In this way, the coil spring provides a force that pushes the front plate forward against the front of the retainer box. A second spring 27 can be added to add further force to keep the front plate securely against the retainer box. The clips can be easily punched out of thin metal and formed into the desired clip shape.

Figure 6:
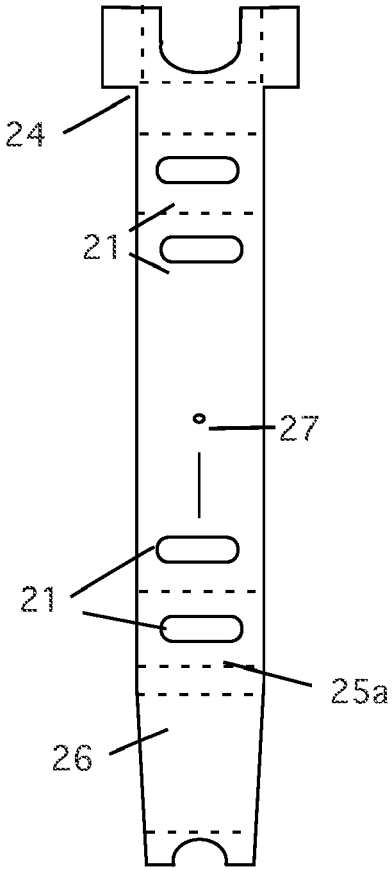
FIG. 6 is a front view of the invention used for medium frames as stamped from a piece of metal before forming.

FIG. 6 is a front view of the invention used for medium frames as stamped from a piece of metal before forming. Here, a typical piece stamped out for forming is shown. The retainer box 24 is formed by folding the top pieces to form the box. Note that the mounting holes are doubled as shown. The front plate 26 is shown at the bottom of the form. The space 25*a* is used to hold spring 25 when it is folded. The point 27 is for the small auxiliary spring.

Figure 7:
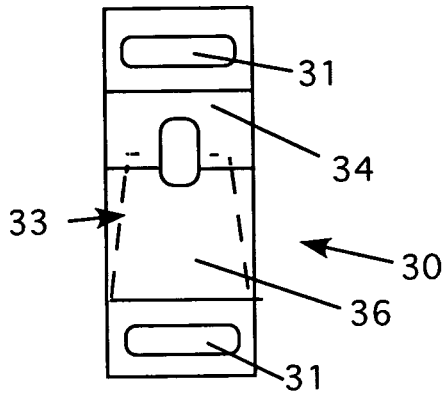
FIG. 7 is a front view of the invention used for large frames.
Figure 8:
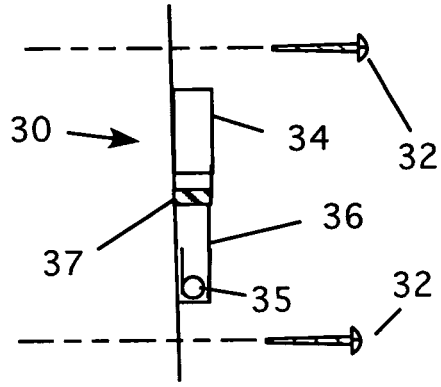
FIG. 8 is a side view of the invention used for large frames.

FIG. 7 is a front view of the invention used for large frames. This clip is formed and used in the same manner as that of the small frame clip, described above. The only real difference is the size of the clip. FIG. 8 is a side view of the invention used for large frames. As before, the clip 30 has two holes 31 for fasteners, such as screws or nails 32 that secure the clip to the frame. The clip also has a spring body 33, which is best shown in FIG. 8. The spring body 33 is shown, as well as the fasteners 32. The spring body has the following features. At the top of the clip is a retainer box 34. At the bottom of the clip is a coil spring 35, which has a front plate 36 attached. The front plate extends up to fit inside the retainer box 34 as shown. In this way, the coil spring provides a force that pushes the front plate forward against the front of the retainer box. A second spring 37 can be added to add further force to keep the front plate securely against the retainer box. The clips can be easily punched out of thin metal and formed into the desired clip shape.

Figure 9:
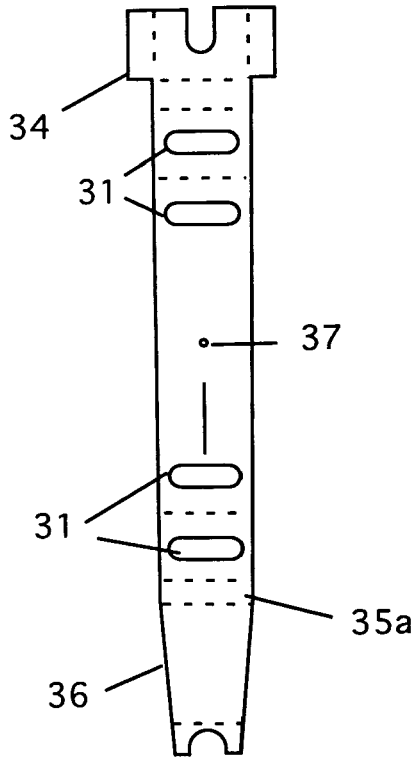
FIG. 9 is a front view of the invention used for large frames as stamped from a piece of metal before forming.

FIG. 9 is a front view of the invention used for large frames as stamped from a piece of metal before forming. It is a front view of the invention used for medium frames as stamped from a piece of metal before forming. Here, a typical piece stamped out for forming is shown. The retainer box 34 is formed by folding the top pieces to form the box. Note that the mounting holes are doubled as shown. The front plate 36 is shown at the bottom of the form. The space 35*a* is used to hold spring 35 when it is folded. The point 37 is for the small auxiliary spring.

Figure 10:
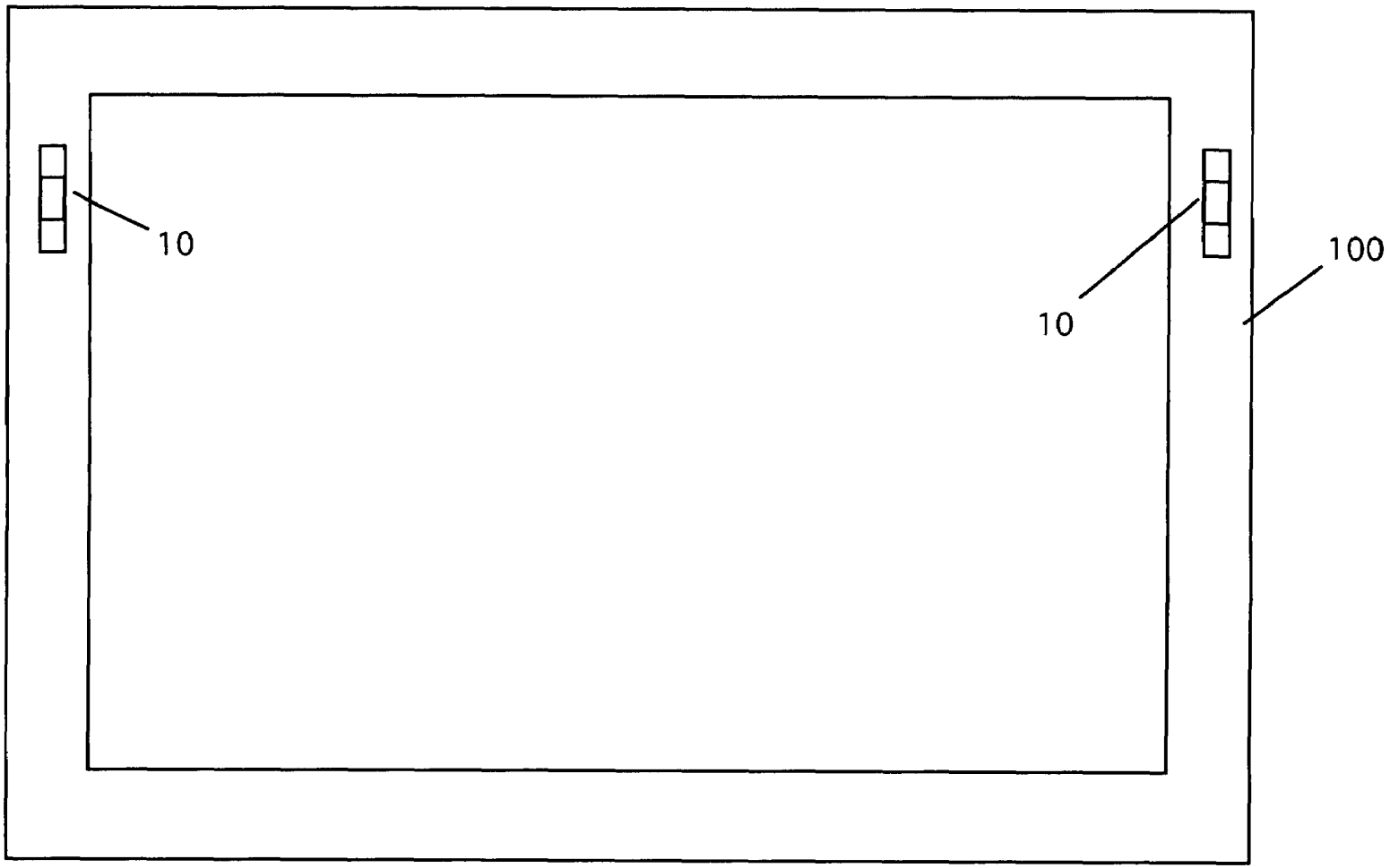
FIG. 10 is a rear view of a picture frame showing the location of the frame clips used as part of the invention.

FIG. 10 is a rear view of a picture frame 100 showing the location of the frame clips 10 used as part of the invention. In the preferred embodiment, the clips are made of lightweight metal and can be color-coded if desired to match the color of a wood frame. For example, a cherry wood frame can have red colored clips, and a walnut frame can have brown colored clips. Of course, the colors can be varied, as desired, or even left off the clips altogether.

Figure 11:
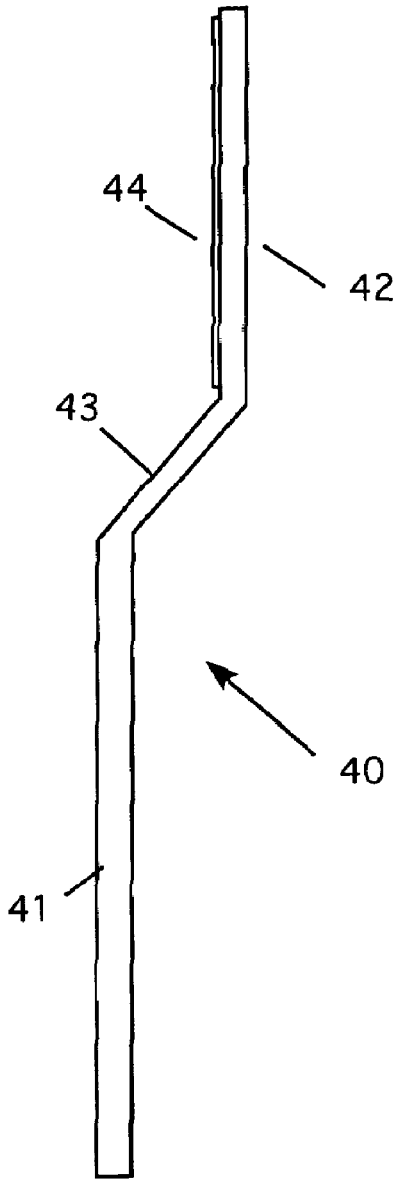
FIG. 11 is a side view of the tool used for removing small picture frames.

FIG. 11 is a side view of the tool used for removing small picture frames. The tool 40 has a handle portion 41, an end portion 42 and a center portion 43 that is angled to offset the end portion from the handle portion. The end portion 42 has a piece of rubber tape 44 applied as shown. The rubber tape provides a non-skid surface for the tool. The tool is used by passing the end portion behind the frame until it meets the front plate of the clip. The front plate is then pushed inwards, against the tension of the spring, until the hook is released. At that point, the side of the frame is free from the wall. This operation is repeated on the other side to remove the frame completely from the wall.

Figure 12:
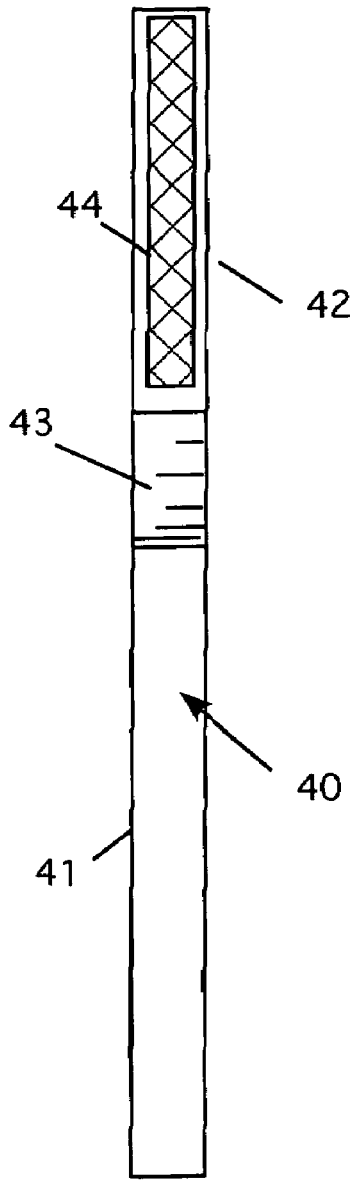
FIG. 12 is a front view of the tool used for removing small picture frames.

FIG. 12 is a front view of the tool used for removing small picture frames. Here, the rubber tape 44 is shown clearly.

Figure 13:
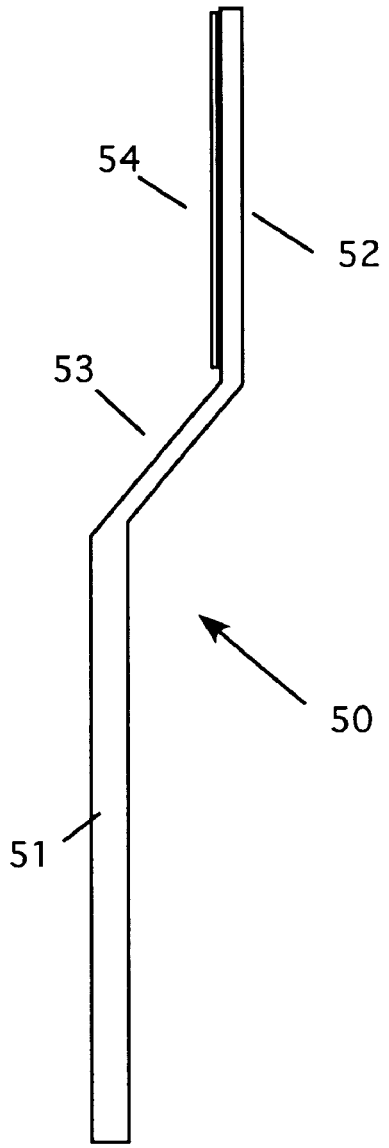
FIG. 13 is a side view of the tool used for removing large picture frames.

FIG. 13 is a side view of the tool used for removing large picture frames. This tool 50 is larger than the first tool. It has a large paddle-like handle 51 to ensure a good grip on the tool. The end portion of the tool 52 is larger than that for the small frame tool. The rubber tape 54 is attached as shown. Note that this handle is also offset be an angled portion 53 as shown. The operation of the tool is the same as that of the small frame tool.

Figure 14:
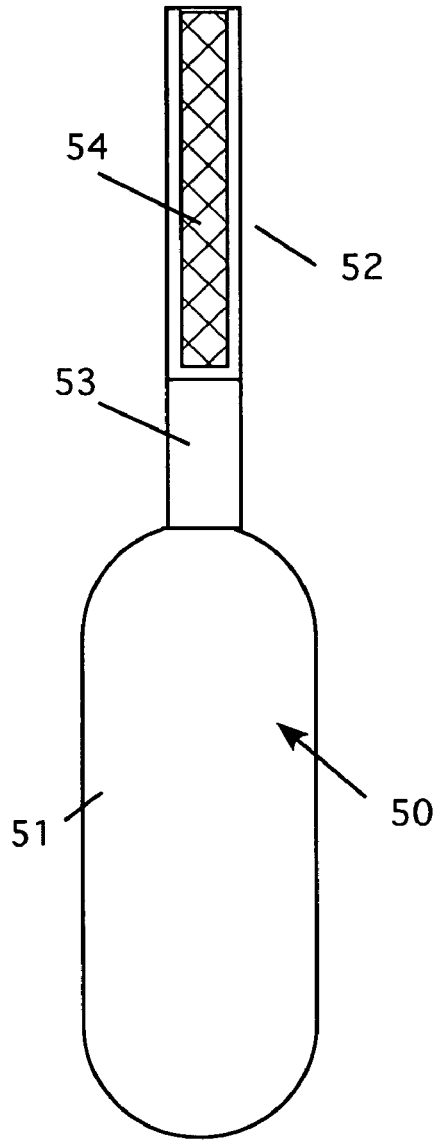
FIG. 14 is a front view of the tool used for removing large picture frames.
Figure 15:
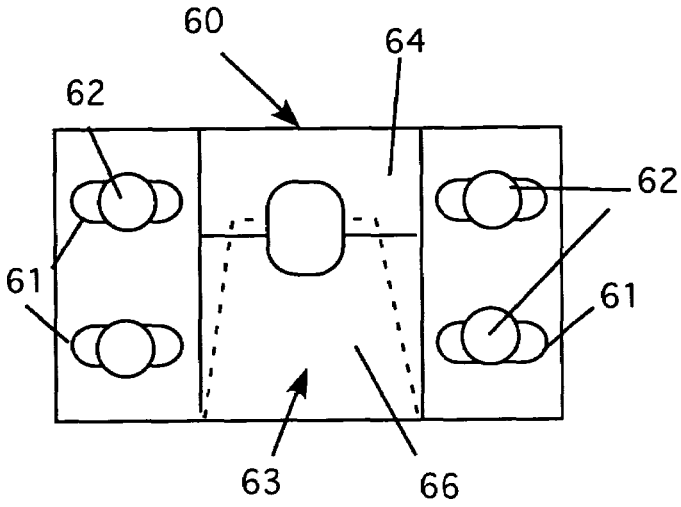
FIG. 15 is a front view of a second embodiment of the invention used for large frames.
Figure 16:
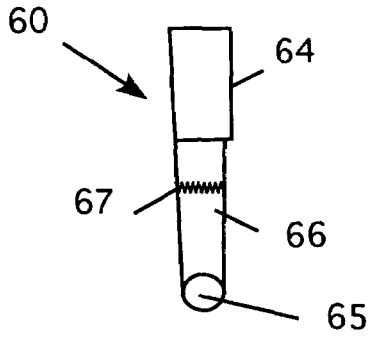
FIG. 16 is a side view of a second embodiment of the invention used for large frames.

FIG. 14 is a front view of the tool used for removing large picture frames. As before, the rubber tape 54 is shown clearly in this view, as well as the paddle-like handle 51, FIG. 15 is a front view of a second embodiment of the invention used for large frames. This embodiment is slightly different in that it has four mounting holes to secure it to a frame. This embodiment also needs a considerable frame that has a large outer perimeter to allow the fasteners holding the clips to get a good purchase in the frame. In this embodiment, the clip 60 is formed as shown. This clip 60 has four holes 61 for fasteners, such as screws or nails 62 that secure the clip to the frame. The clip also has a spring body 63, which is best shown in FIG. 16. Here, the spring body 63 is shown, as well as the fasteners 62. The spring body has the following features. At the top of the clip is a retainer box 64. At the bottom of the clip is a coil spring 65, which has a front plate 66 attached. The front plate extends up to fit inside the retainer box 64 as shown. In this way, the coil spring provides a force that pushes the front plate forward against the front of the retainer box. A second spring 67 can be added to add further force to keep the front plate securely against the retainer box. The clips can be easily punched out of thin metal and formed into the desired clip shape.

Figure 17:
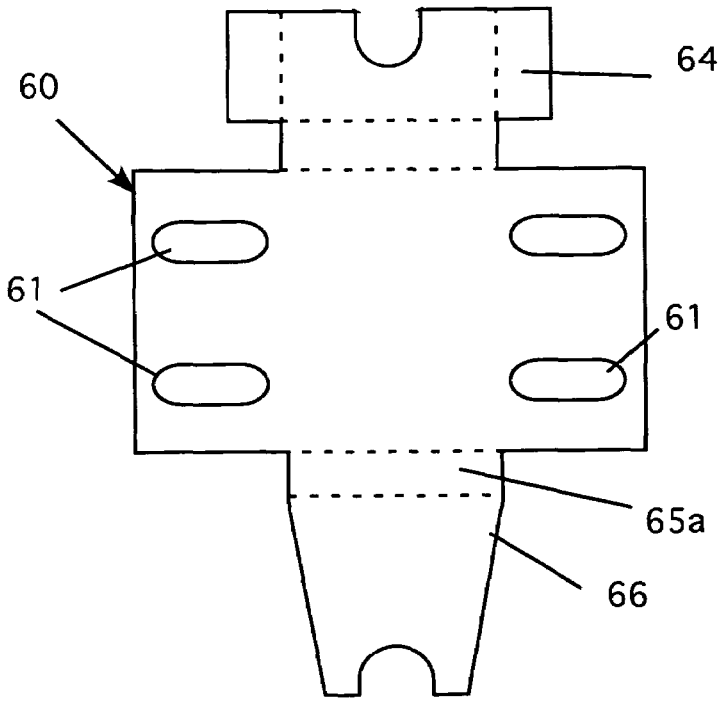
FIG. 17 is a front view of a second embodiment of the invention used for large frames as stamped from a piece of metal before forming.

FIG. 17 is a front view of a second embodiment of the invention used for large frames as stamped from a piece of metal before forming. In this embodiment, the retainer box 64 is formed by folding the top pieces to form the box. Note that the mounting holes in this embodiment are not folded and doubled. They are positioned on the outside of the form as shown. The front plate 66 is shown at the bottom of the form. The space 65*a* is used to hold spring 65 when it is folded.

Figure 18:
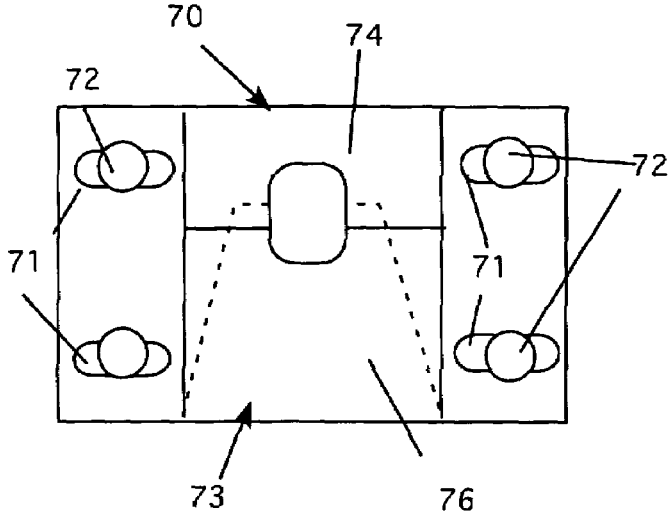
FIG. 18 is a front view of a second embodiment of the invention used for very large frames.
Figure 19:
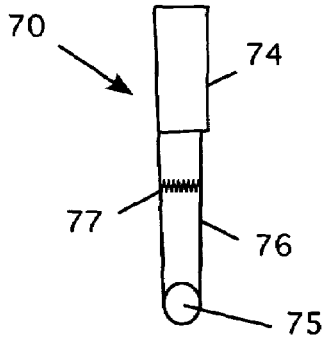
FIG. 19 is a side view of a second embodiment of the invention used for very large frames.
Figure 20:
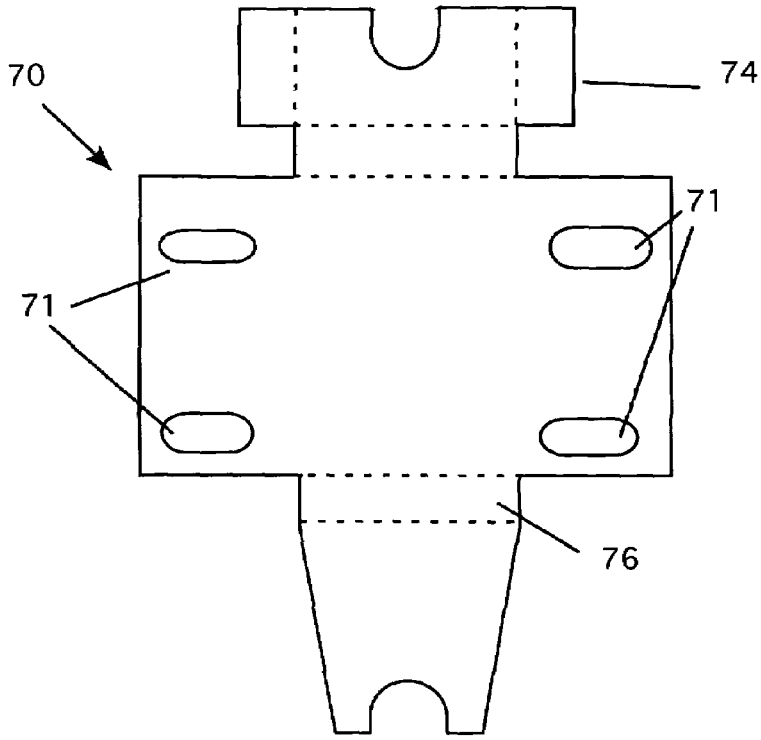
FIG. 20 is a front view of a second embodiment of the invention used for very large frames as stamped from a piece of metal before forming.

FIGS. 18, 19 and 20 show views of a second embodiment 70 of the invention used for very large frames. This clip is the same as that of FIGS. 15-17 except for the size. This form is larger to accommodate even heavier frames.

Figure 21:
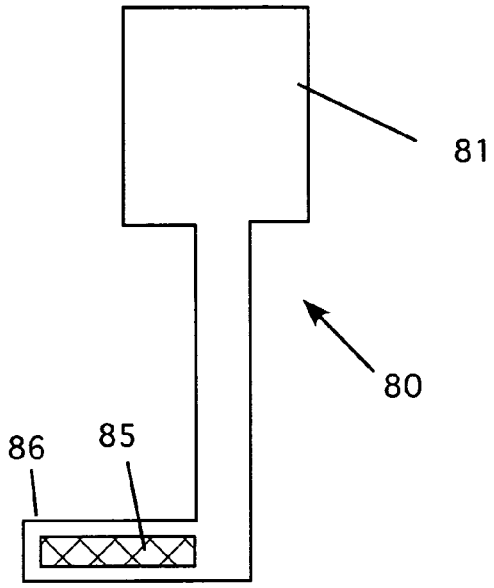
FIG. 21 is a front view of a tool used for removing picture frames from the second embodiment of clip.
Figure 22:
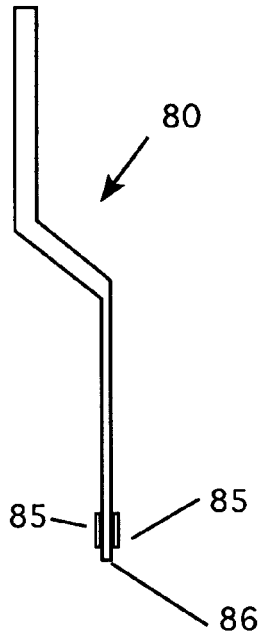
FIG. 22 is a side view of the tool used for removing picture frames from the second embodiment of clip.
Figure 23A:
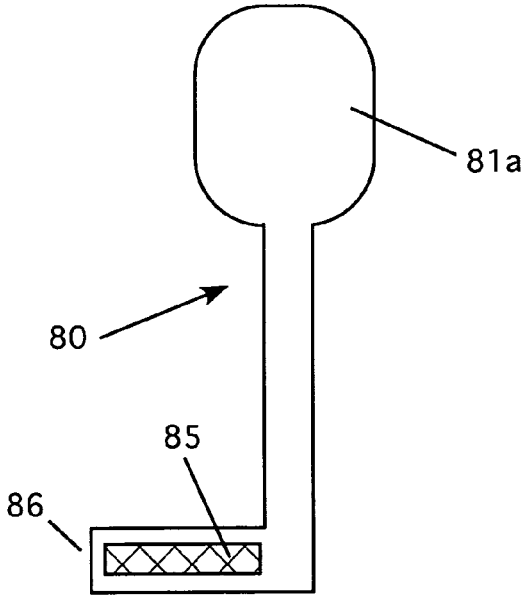
FIG. 23*a* is a front view of the right hand tool used for removing picture frames from the second embodiment of clip.
Figure 23B:
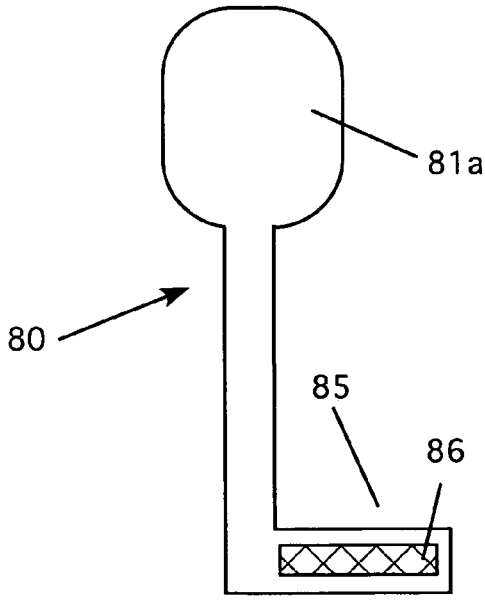
FIG. 23*b* is a front view of the left hand tool used for removing picture frames from the second embodiment of clip.

FIGS. 21, 22, 23*a* and 23*b* show the tool 80 used to release the clip of the second embodiment. The difference between FIGS. 21 and 23 is the shape of the handle portion 81 and 81*a*. FIG. 21 shows a generally square handle while FIG. 23 shows an ovular handle. In addition, FIGS. 23*a* and 23*b* show that these tools are used as a "right" tool and a "left" tool. The figures show the correct orientation for each tool. Of course, either tool can be used for either hand, as long as it is oriented properly.

FIG. 22 is a side view of the tool used for removing picture frames from the second embodiment of clip. Note that this tool has two pieces of rubber tape 85 secured to the end portion 86. As mentioned above the tape on both sides of the end portion are to accommodate the tool being used as a right hand tool or a left hand tool.

This tool is used in the same manner as the smaller tools. The end portion is used to push the end plate back to release the hook from the clip.

Figure 24:
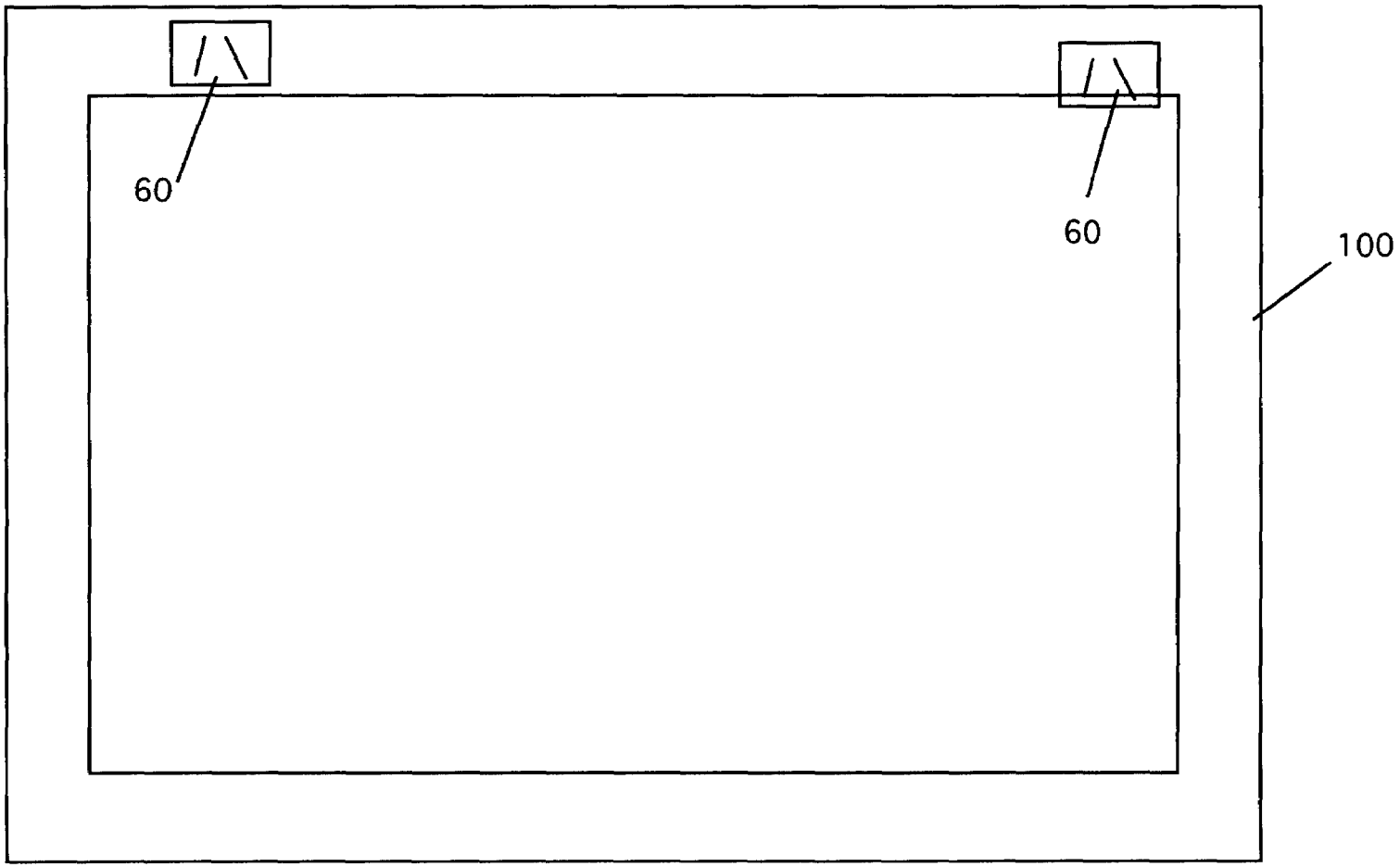
FIG. 24 is a rear view of a picture frame showing the location of the second embodiment of frame clips used as part of the invention.

FIG. 24 is a rear view of a picture frame 100 showing the location of the second embodiment of frame clips 60 used as part of the invention.

Figure 25:
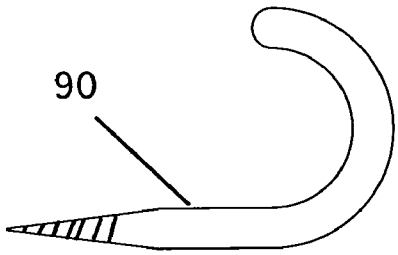
FIG. 25 is a detail view of one of the means for attaching the clip to a wall.
Figure 26:
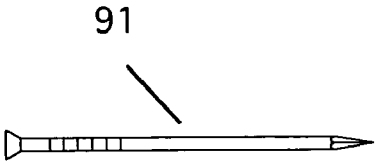
FIG. 26 is a detail view of a second means for attaching the clip to a wall.
Figure 27:
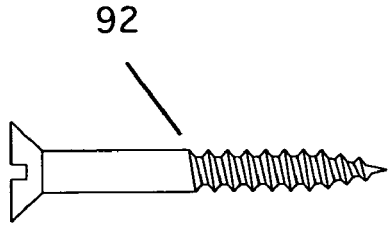
FIG. 27 is a detail view of a third means for attaching the clip to a wall.

Finally, the frame with the clips is secured to a wall, as mentioned above by a means for attaching the clip to a wall. These means include a hook 90 (FIG. 25), a nail 91 (FIG. 26 or a screw 92 (FIG. 27).

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An earthquake-proof system for hanging pictures and other panel-shaped articles comprising:

a) A clip, said clip having a means for securing said clip to a frame, said clip also having a top and a bottom and a back vertical portion;

b) a retainer box formed at the top of said clip, said retainer box having a front lip; and c) a coil spring, located at the bottom of said clip, said coil spring being positioned horizontally within the bottom of said clip;

d) a generally rectangular front plate front plate, fixedly attached to said coil spring, and further wherein said generally rectangular front plate has a top portion and further wherein the top portion of said front plate is positioned with the retainer box, such that the top portion of said front plate is resiliently restrained against an inside face of said front lip of said retainer box.

2. The earthquake-proof system for hanging pictures of claim 1 further comprising a second spring having two ends, one end being attached to the back vertical portion of said clip and the other end being attached to the front plate.

3. The earthquake-proof system for hanging pictures of claim 1 wherein the means for securing said clip to a frame comprise a pair of mounting holes formed in said clip.

4. The earthquake-proof system for hanging pictures of claim 3 wherein the means for securing said clip to a frame further comprise a pair of fasteners, placed through said pair of mounting holes and being secured in said frame.

5. The earthquake-proof system for hanging pictures of claim 1 further comprising: a means for attaching said clip to a wall.

6. The earthquake-proof system for hanging pictures of claim 5 wherein the means for attaching said clip to a wall is selected from the group of a hook, a nail or a screw.

7. The earthquake-proof system for hanging pictures of claim 1 further comprising a tool for releasing said clip from a fastener.

8. The earthquake-proof system for hanging pictures of claim 7 wherein the tool has a handle portion and an end portion.

9. The earthquake-proof system for hanging pictures of claim 8 wherein the end portion is offset laterally from the handle portion.

10. The earthquake-proof system for hanging pictures of claim 7 further comprising: a length of non-slip tape, attached to said tool.

11. The earthquake-proof system for hanging pictures of claim 8 further comprising: a length of non-slip tape, attached to the end portion of said tool.

12. An earthquake-proof system for hanging pictures and other panel-shaped articles comprising:

a) a clip, said clip also having a top, a bottom, and a back vertical portion;

b) a retainer box formed at the top of said clip, said retainer box having a front lip;

c) a coil spring, located at the bottom of said clip, said coil spring being positioned horizontally within the bottom of said clip;

d) a generally rectangular front plate front plate, fixedly attached to said coil spring, and further wherein said generally rectangular front plate has a top portion and further wherein the top portion of said front plate is positioned with the retainer box, such that the top portion of said front plate is resiliently restrained against an inside face of said front lip of said retainer box; and (e) a pair of flanges, attached to said clip and being oppositely disposed on said clip, said flanges further having at least one mounting hole formed therein.

13. The earthquake-proof system for hanging pictures of claim 12 further comprising a second spring having two ends, one end being attached to the back vertical portion of said clip and the other end being attached to the front plate.

14. The earthquake-proof system for hanging pictures of claim 12 further comprising a pair of fasteners, placed through said at least one mounting hole.

15. The earthquake-proof system for hanging pictures of claim 12 further comprising: a means for attaching said clip to a wall.

16. The earthquake-proof system for hanging pictures of claim 15 wherein the means for attaching said clip to a wall is selected from the group of a hook, a nail or a screw.

17. The earthquake-proof system for hanging pictures of claim 12 further comprising a tool for releasing said clip from a fastener.

18. The earthquake-proof system for hanging pictures of claim 17 wherein the tool has a handle portion and an end portion.

19. The earthquake-proof system for hanging pictures of claim 18 wherein the end portion is offset laterally from the handle portion.

20. The earthquake-proof system for hanging pictures of claim 18 further comprising: a length of non-slip tape, attached to the end portion of said tool.

* * * * *